United States Patent [19]

Rosenberger

[11] 4,083,497

[45] Apr. 11, 1978

[54] SPRAY GUN

[75] Inventor: Edwin C. Rosenberger, Piqua, Ohio

[73] Assignee: Chem-Lawn Corporation, Dublin, Ohio

[21] Appl. No.: 692,313

[22] Filed: Jun. 3, 1976

[51] Int. Cl.[2] ..... B05B 7/02

[52] U.S. Cl. ..... 239/526; 251/43

[58] Field of Search ..... 239/525, 526, 378, 375; 251/43

[56] References Cited

U.S. PATENT DOCUMENTS

| | | | |
|---|---|---|---|
| 1,438,239 | 12/1922 | Heinrich | 239/526 X |
| 2,362,946 | 11/1944 | Stockdale | 239/526 X |
| 2,795,460 | 6/1957 | Bletcher et al. | 239/375 X |
| 2,910,248 | 10/1959 | Kueter et al. | 239/526 |
| 2,936,959 | 5/1960 | Nord et al. | 239/525 X |
| 3,927,834 | 12/1975 | Tada | 239/526 X |

*Primary Examiner*—Joseph F. Peters, Jr.
*Assistant Examiner*—Michael Mar
*Attorney, Agent, or Firm*—William S. Rambo

[57] ABSTRACT

A spray gun of synthetic resin composition having a hollow barrel with a pistol grip handle including an actuating trigger pivoted from the butt end of the handle, the trigger being mounted to open and close a valve which, in closed position, seals against a valve seat in a passage between the inlet and the outlet of the spray gun. A spring is provided to urge the trigger and valve toward closed position while a latch is positioned on the free end of the trigger to lock the valve member in open position. Hydraulic balance of the valve member is achieved by proper dimensioning and arrangement of the fluid passage, valve member, valve stem and other related parts.

4 Claims, 7 Drawing Figures

SPRAY GUN

BACKGROUND OF THE INVENTION

Hose-connected spray guns or nozzles are usually intended to spray or dispense water or other non-corrosive liquids and are generally constructed of brass or other metallic materials. However, when such guns or nozzles are used for dispensing insecticides, fertilizer, herbicides and the like, corrosion occurs quickly and impaired function and/or failure result in short order.

There is a need in the industry for an improved spray gun, particularly for dispensing aqueous solutions of garden and lawn treatment chemicals, which will resist corrosion and have a long functional life.

SUMMARY OF THE INVENTION

To fill this need a spray gun according to this invention is formed almost entirely from synthetic resin and includes a hollow barrel section having relatively parallel, but axially offset inlet and outlet passages. A pistol grip handle section extends transversely from the barrel and a valve chamber is formed at the juncture of the handle and barrel sections between the offset inlet and outlet passages of the spray gun. A reciprocal valve member is mounted for movement in the valve chamber between opened and closed positions in respect to a valve seat formed at one end of the valve chamber. Movement of the valve member is controlled manually by a trigger pivotally mounted from the lower end of the handle section. The trigger is connected to one end of an elongated valve stem which extends to the valve member. A tubular sleeve is mounted in sealing engagement with the walls of the valve chamber and the valve stem slidably passes through the sleeve. Sealing means is provided between the valve stem and the sleeve to prevent fluid from escaping into the handle section from the valve chamber.

On the free outer end of the trigger member is a sliding lock which in one position is designed to hook behind a ledge on a part of the pistol grip to lock the trigger in position and hold the valve member in open position. Without the lock being in operable position a spring biasing means mounted within the handle urges the valve member toward closed position.

DESCRIPTION OF THE PREFERRED EMBODIMENT

Figure 1:
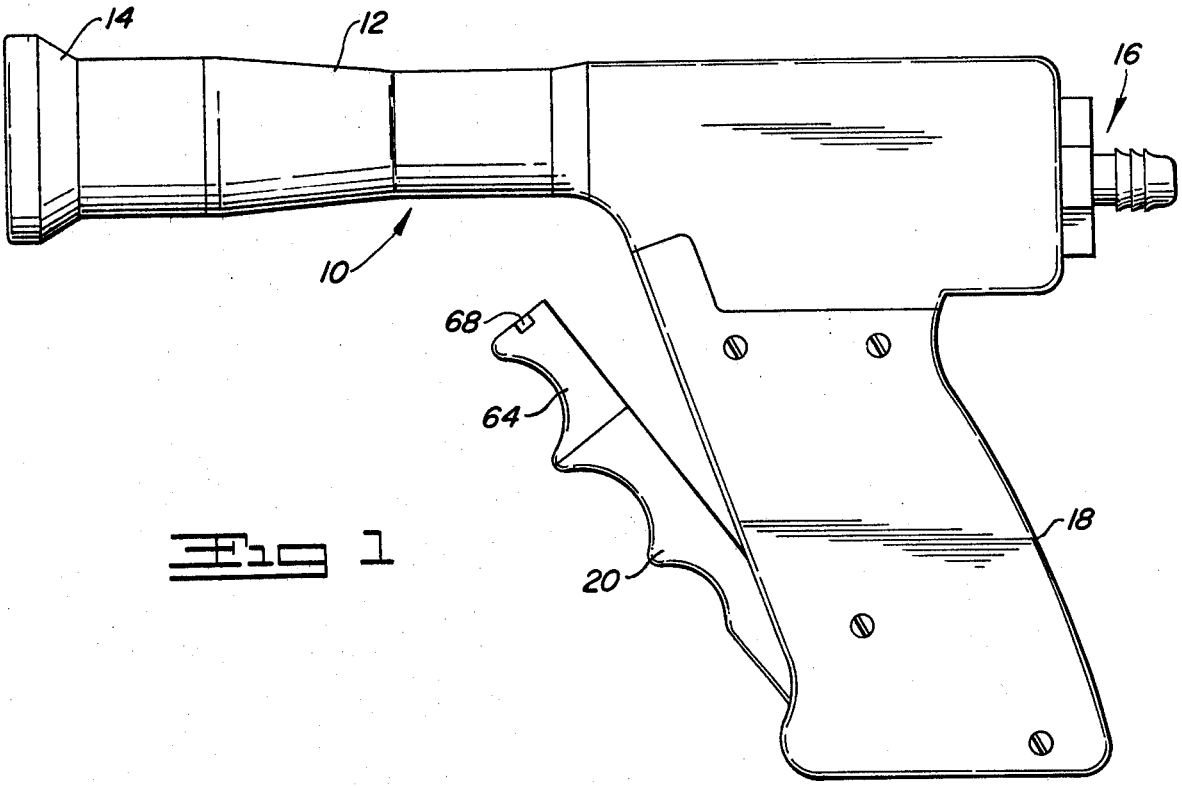
FIG. 1 is an elevational view of a spray gun according to this invention.

FIG. 1 illustrates a spray gun 10 composed almost entirely of synthetic resinous materials and having a barrel 12 with an attached spray nozzle 14 at one end and a nipple-type hose fitting 16 threaded into the other end. A pistol grip or handle 18 extends transversely from the barrel and supports a bell crank-type trigger 20 for controlling the operation of the spray gun.

Figure 2:
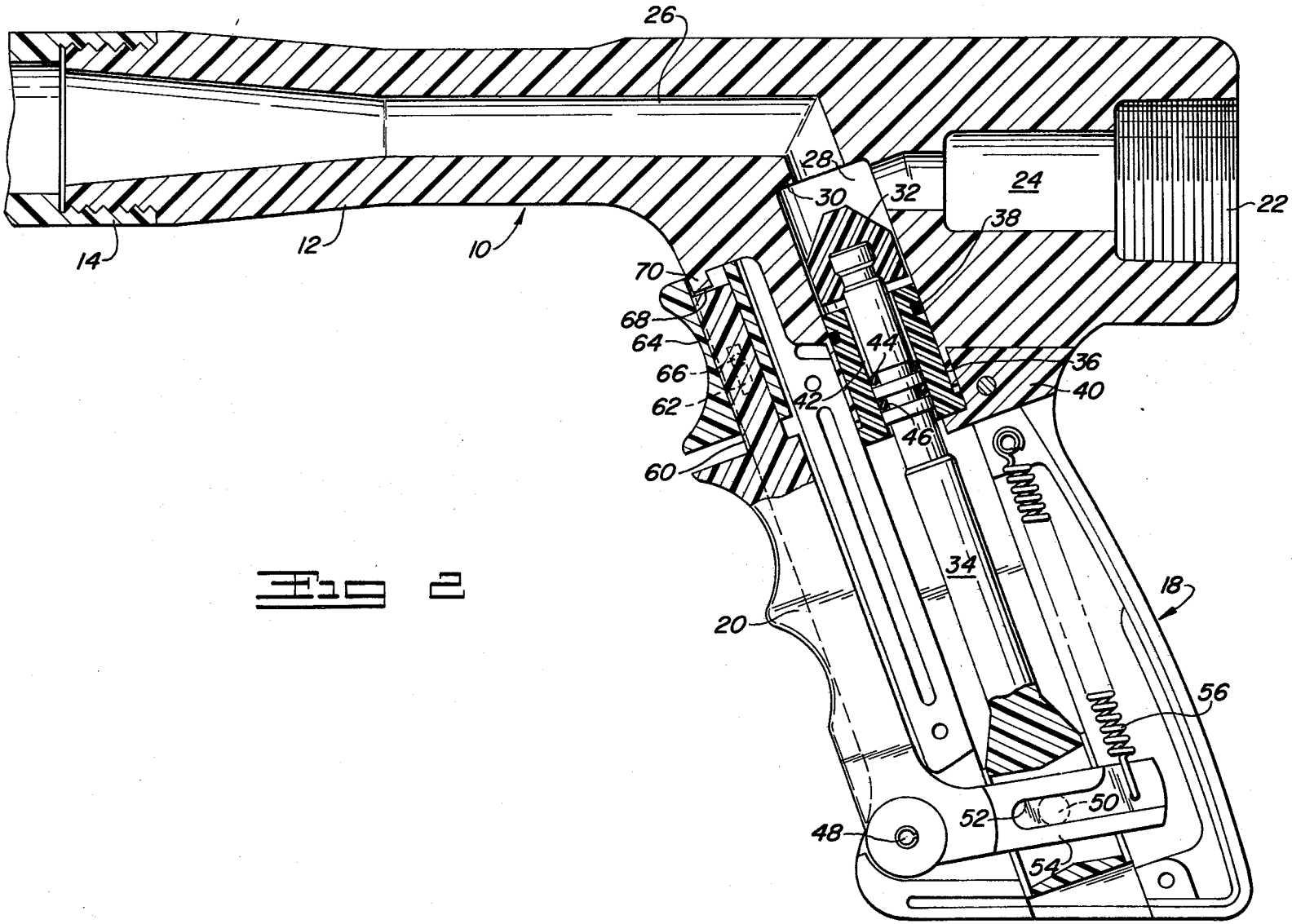
FIG. 2 is an enlarged, medial, vertical sectional view of the spray gun showing the valve in open position and with the trigger lock in place.
Figures 3, 4, 5:
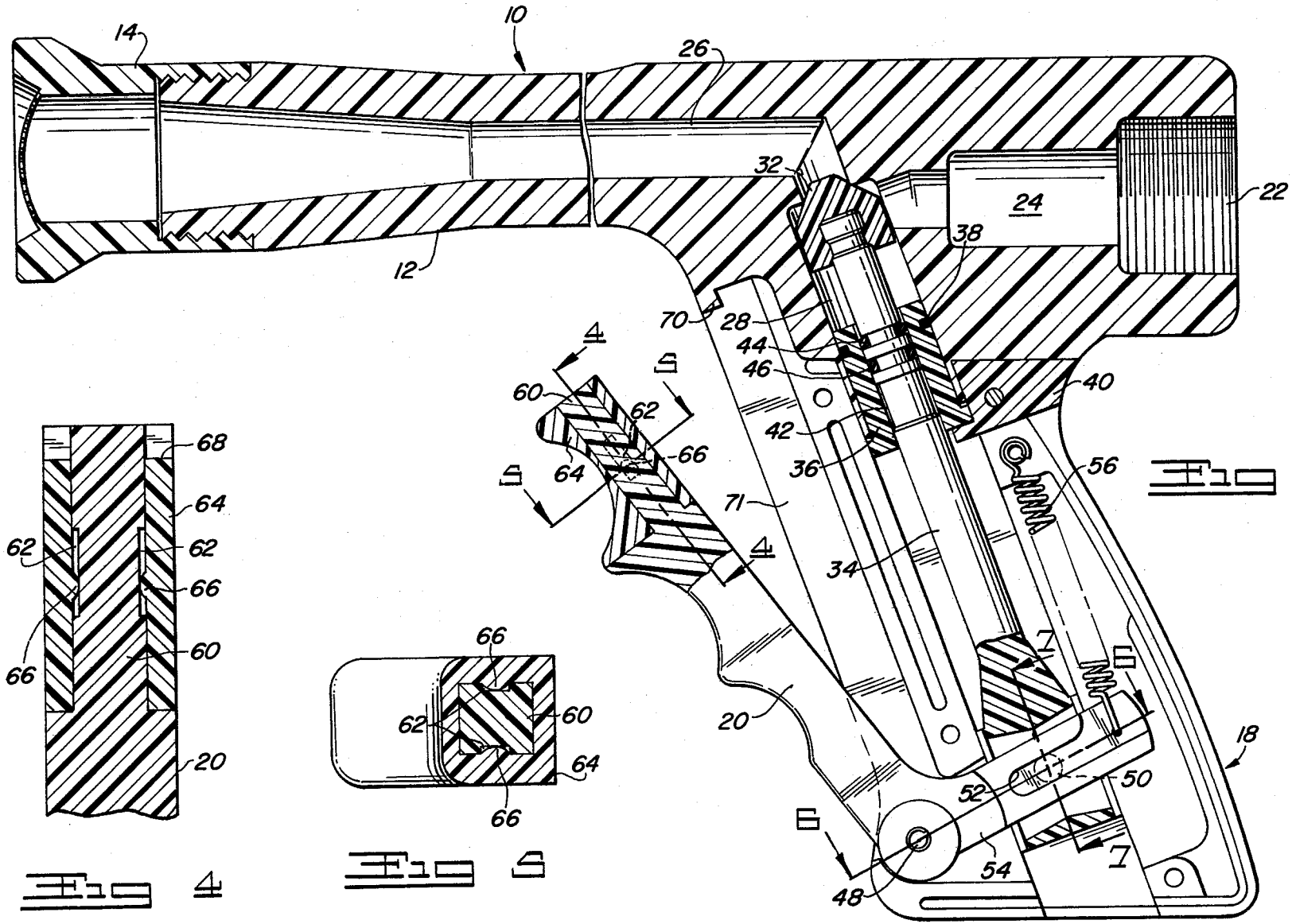
FIG. 3 is a view similar to FIG. 2, but showing the trigger in unlocked position and the valve in closed position.
FIG. 4 is a detailed sectional view of the trigger locking mechanism taken along line 4—4 of FIG. 3.
FIG. 5 is a transverse sectional view of the trigger locking mechanism taken along line 5—5 of FIG. 3.

Referring to FIGS. 2 and 3, the gun is designed to receive liquid under pressure from a hose (not shown) connected with the fitting 16 and to discharge such liquid in a spray from the nozzle 14. The hollow barrel 12 is formed at one end with a screw-threaded socket 22 to receive the fitting 16 and the socket 22 is in direct communication with an inlet passage 24. The barrel is formed at the opposite end with an outlet passage 26 communicating with the nozzle 14 and disposed in parallel but axially offset relation to the inlet passage 24. A valve chamber 28 intersects and separates the inlet and outlet passages 24 and 26.

A valve seat 30 at one end of the chamber is shaped to receive a synthetic resin valve member 32 in sealing engagement therewith. The valve member 32 is mounted on one end of an elongated valve stem 34 and is designed to reciprocate within the valve chamber between open position, as shown in FIG. 2, and closed position abutting the valve seat 30, as shown in FIG. 3.

A tubular bearing sleeve 36 is mounted in the valve chamber 28 and carries an annular sealing ring 38 within a groove in the periphery of the sleeve. Removable blocking means 40 holds the sleeve in stationary position within the valve chamber.

The valve stem 34 projects through the axial bore 42 of the sleeve 36 and is arranged to reciprocate in the sleeve in response to manual actuation of the trigger 20. A pair of O-ring seals 44 and 46 are mounted in grooves in the outer peripheral surface of the stem and provide a double seal between the stem and the sleeve.

The portion of the valve stem 34 in the area of the sleeve 36 is reduced in diameter to allow debris and/or small solid particles which might be entrained in the solution passing through the gun to easily slide with the stem and be purged with the next opening and closing of the valve without wedging or jamming the valve stem into a locked position.

Reciprocation of the valve stem is obtained by manual operation of the trigger 20 which is pivotally mounted at 48 on the handle at a location remote from the barrel 12. The mounting location of the trigger 20 is significant as will be explained subsequently.

Figure 6:
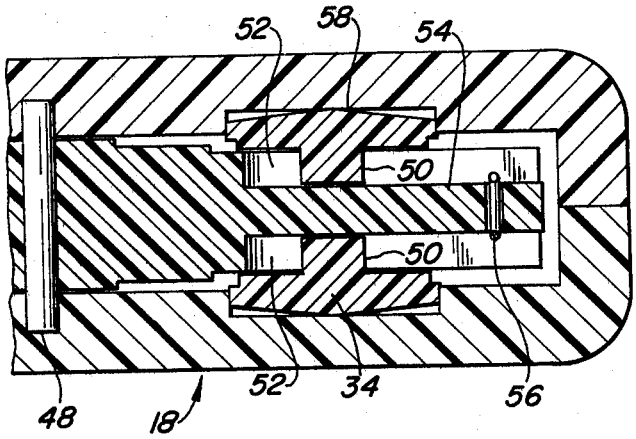
FIG. 6 is a transverse sectional view taken along line 6—6 of FIG. 3 and showing the connection between the trigger and valve stem.
Figure 7:
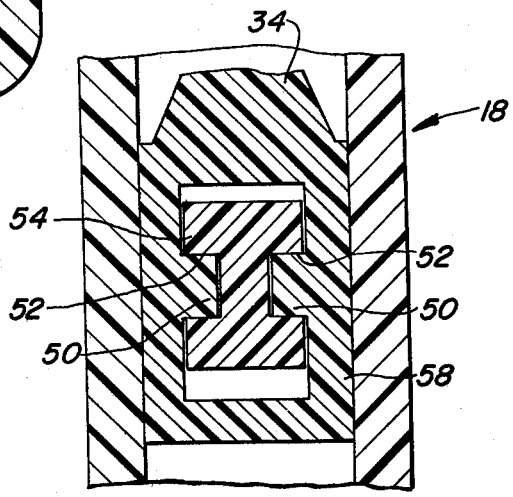
FIG. 7 is a detailed fragmentary sectional view of the trigger-valve stem connection taken along line 7—7 of FIG. 3.

A trigger connecting means is illustrated in section in FIGS. 6 and 7 and includes two inwardly projecting lugs 50 formed on the valve stem 34 and which project into two side grooves 52 in the trigger extension 54. The lugs project generally parallel with the axis of the trigger pivot 48 and perpendicular to the line of reciprocation of the valve stem 34. Manual actuation of the trigger 20 causes its bell crank extension 54 to pivot about pivot-point 48 and pull the valve stem downward while the contractile spring 56 biases the trigger 20 and the stem 34 toward valve closing position. The sleeve 36 guides and supports one end portion of the stem for axial sliding movement while the other end of the stem terminates in a relatively enlarged, slotted box section 58 which receives the bell crank extension 54 (see FIG. 6). The box section 58 also guides the lower end portion of the valve stem within the handle section. When the trigger extension 54 pivots downwardly in the handle, it engages the lugs 50 which project into the grooves 52 and thus pulls downwardly on the valve stem 34. At the same time, the sliding connection between the grooves 52 of the trigger extension 54 and the lugs 50 of the valve stem permits the stem to move axially without binding in the handle.

To enable an operator of the spray gun to lock the valve in open position during a prolonged spraying period without holding the trigger manually against spring tension, a convenience lock is provided on the free end of the trigger. This lock comprises a rectangular extension or projection 60 on the outer end of the trigger 20. The projection 60 is formed on the opposite sides with a pair of grooves or recesses 62. A sliding latch 64 is mounted for limited sliding movement on the projection 60 by means of a pair of detents 66 which project into and slide along the grooves 62. A notch 68 is formed in the outermost end of the latch 64 and is engageable with a catch or shoulder 70 formed at the upper end of the trigger-receiving recess 71 of the handle. As shown in FIG. 3, the latch 64 is normally carried in a retracted position on the extension 60 so that it will clear the catch 70. If it is desired to lock the trigger in fully open position, the latch may be moved outwardly on the extension 60, as illustrated in FIG. 2, so as to engage the notch 68 with the catch 70. When engaged, the trigger lock prevents movement of the valve to a closed position under action of the spring 56, and sprinkling may continue until such time as the locking means is manually released and the trigger is returned to the position shown in FIGS. 1 and 3.

The pivotal mounting of the trigger 20 at or near the outer or butt end of the handle, rather than toward the upper or inner end of the handle is important for the following reasons. First, the strongest fingers on the hand of an operator are usually the index and middle fingers which are located closest the barrel when one grips the gun. Thus, with the illustrated mounting the strongest fingers will rest near the free end of the trigger and thereby the longest lever arm will be located where the greatest strength exists. The second reason is that when spraying is interrupted or completed the hose is usually retracted and rewound onto a reel, and the spray gun is dropped onto and pulled over the surface of the ground. Therefore, as the hose and gun are dragged over the ground, the free end of the trigger is shielded against snagging and accidental opening since it occupies a protected position within the entrant corner at the juncture of the barrel and pistol grip handle. Whereas, with a trigger of conventional design (pivoted from the barrel area) the free end of the trigger is more apt to catch or snag on a bush or other ground obstructions and snap off the trigger, or cause the operator to return to the end of the hose and disentangle the gun.

Another significant feature of the improved spray gun is the hydraulically balanced condition of the valve member 32 when it occupies its closed position in seated engagement with the valve seat 30. As shown in FIG. 3, the diameter of the valve member 32 is slightly less than that of the chamber 28. This permits fluid from the inlet passage 24 to pass around and beneath the valve member 32. When the valve member 32 is seated against the seat 30, that part of the tapered outer end surface of the valve member which extends outwardly beyond the seat defines a pressure area substantially equal to that defined by the opposite lower end of the valve member which extends radially outwardly from the valve stem 34. Thus, the pressure of fluid within the inlet passage 24 is applied to the opposed, equal area surfaces of the valve member to hydraulically balance it when it occupies its closed position. This enables the valve member to be opened easily and smoothly without overcoming any substantial force applied thereto by the incoming liquid.

While a single preferred embodiment has been illustrated and described in detail, it should be understood that various modifications in design and details of construction are possible without departing from the spirit of this invention or the scope of the following claims.

I claim:

1. A spray gun for liquid insecticides or the like comprising:

(a) a pistol-shaped body of synthetic resin composition having generally hollow barrel and handle sections, the barrel section of said body being formed at opposite ends thereof with relatively parallel but axially offset inlet and outlet passages separated by an intermediate relatively intersecting valve chamber terminating in a valve seat adjacent said outlet passage;

(b) a valve member of synthetic resin composition reciprocable in the valve chamber of said body and movable into and out of seated engagement with the valve seat of said valve chamber to thereby control the flow of liquid from the inlet passage to the outlet passage of said body, said valve member including relatively opposed, substantially equal area surfaces in fluid communication with the inlet passage of said body for hydraulically balancing said valve member when it is engaged with said valve seat;

(c) an elongated valve stem of synthetic resin composition directly connected at one end thereof to said valve member and reciprocable within the handle section of said body for moving said valve member into and out of seated engagement with said valve seat;

(d) a bell crank trigger member pivoted in the handle section of said body and connected to reciprocate said valve stem, said trigger member including a manually operable lever portion extending outwardly to one side of said handle section; and (e) spring means in the handle section of said body connected to said trigger member and biasing said valve stem toward a valve-closing position.

2. A spray gun according to claim 1, including: a spool-shaped guide sleeve of synthetic resin composition positioned in the valve chamber of said body and having an axial bore through which said valve stem extends; and a plurality of liquid seals between said sleeve and said valve chamber and said valve stem.

3. A spray gun according to claim 1, including: locking means carried on the manually operable lever portion of said trigger member and selectively engagable with the handle section of said body to hold said trigger member in a valve-opening position.

4. A spray gun according to claim 1, wherein the inlet passage of said body includes a screw-threaded socket to detachably receive a hose connection.

* * * * *